United States Patent [19]

Stevens

[11] Patent Number: 4,817,701

[45] Date of Patent: Apr. 4, 1989

[54] METHOD AND APPARATUS FOR HORIZONTAL CONTINUOUS CASTING

[75] Inventor: Thomas J. Stevens, Orange, Calif.

[73] Assignee: Steel Casting Engineering, Ltd., Orange, Calif.

[21] Appl. No.: 173,104

[22] Filed: Mar. 28, 1988

Related U.S. Application Data

[63] Continuation of Ser. No. 82,283, Aug. 6, 1987, abandoned, which is a continuation of Ser. No. 814,816, Dec. 30, 1985, abandoned, which is a continuation of Ser. No. 740,152, Jun. 6, 1985, abandoned, which is a continuation of Ser. No. 641,285, Aug. 16, 1984, abandoned, which is a continuation of Ser. No. 402,062, Jul. 26, 1982, abandoned.

[51] Int. Cl.[4] ..... B22D 11/00

[52] U.S. Cl. ..... 164/415; 164/440

[58] Field of Search ..... 164/415, 440, 475, 490

[56] References Cited

U.S. PATENT DOCUMENTS

| | | | |
|---|---|---|---|
| 3,530,926 | 9/1970 | Wertli | 164/490 |
| 3,630,266 | 12/1971 | Watts | 164/490 |
| 3,987,840 | 10/1976 | Birat | 164/490 |
| 3,996,995 | 12/1976 | Marsh | 164/440 |
| 4,183,394 | 1/1980 | Viessmann | 164/475 |

FOREIGN PATENT DOCUMENTS

| | | | |
|---|---|---|---|
| 53-77839 | 7/1978 | Japan | 164/415 |
| 56-136266 | 10/1981 | Japan | 164/475 |

*Primary Examiner*—Richard K. Seidel

*Attorney, Agent, or Firm*—Herbert E. Kidder

[57] ABSTRACT

Molten metal is fed into a liquid-cooled horizontal caster through a ceramic nozzle to form a continuous wire or rod, that is drawn out of the exit end of the mold in incremental steps by a pair of intermittently-driven pinch rolls. The nozzle is preferably made of zirconium oxide, which is slightly porous and at temperatures above 1100° F. has the property of allowing gas to pass through at a much greater rate than at lower temperatures. The nozzle is mechanically attached to the end of the liquid-cooled caster. A shroud, or manifold, surrounds the nozzle for at least a portion of its length, and also enclosed the interface between nozzle and caster. The manifold is supplied with a dry, inert gas such as argon, so that at elevated temperatures, any oxygen is purged from the pores of the zirconium oxide nozzle and is replaced by the inert gas, thereby eliminating any oxygen that would otherwise be present at the interface between the nozzle and the molten metal. Thus, there is formed at the interface surrounding the molten metal a shielding environment of inert gas which is totally non-reactive with the hot metal.

2 Claims, 1 Drawing Sheet

METHOD AND APPARATUS FOR HORIZONTAL CONTINUOUS CASTING

This application is a continuation of Ser. No. 082,283, filed Aug. 6, 1987, now abandoned, which is a continuation of Ser. No. 814,816, filed Dec. 30, 1985, now abandoned, which is a continuation of Ser. No. 740,152, filed June 6, 1985, now abandoned, which is a continuation of Ser. No. 641,285, filed Aug. 16, 1984, now abandoned, which is a continuation of Ser. No. 402,062, filed July 26, 1982, now abandoned.

BACKGROUND OF THE INVENTION

The present invention pertains to the art of continuous casting of metals, and more specifically to a new and improved method and apparatus for horizontal continuous casting, wherein molten metal is fed through a nozzle of ceramic or refractory metal into a stationary, liquid-cooled mold to form a continuous wire, or rod, that is drawn out of the exit end of the mold in incremental steps by a pair of pinch rolls. The apparatus is particularly adapted for producing welding consumables in cobalt, nickle, and iron base alloys, and is presently designed for small sections of 3 mm to 8 mm cross-sectional dimensions, although not limited to such sizes.

A continuous caster of the type described above has been manufactured and sold by Steel Casting Engineering, Ltd., of Orange, Calif., for several years, and has enjoyed considerable commercial success. However, in the course of on-going development to improve and perfect the machine, it has been observed that the surface of the cast wire, or rod, is slightly discolored at regular intervals along its length, apparently due to oxidation, and that oxides formed within the casting machine were tending to damage the ceramic nozzle and to erode the walls of the liquid-cooled mold, so that the life of the mold was shortened through loss of dimensional integrity. Moreover, if the refractory metal of the nozzle forms an oxide which can be absorbed by the metal being cast, the chemistry of the metal can be changed enough to cause the product to be out of specification.

The discolorations on the cast wire, or rod, appeared to have been formed within the casting machine at the location where the nozzle joins the liquid-cooled mold, as each individual discoloration was closely adjacent one of the almost imperceptible casting marks produced by the step-by-step advancement of the wire. The puzzling aspect of the problem was that the metal is not exposed to the atmosphere at this point, and therefore there was no apparent source of oxygen to produce this oxidation. While the ceramic nozzle is very slightly porous, it did not appear to be sufficiently porous to account for the amount of oxidation that was occurring.

The only remaining possibility was that, somehow, oxygen was getting in to the hot metal through the interface between the nozzle and the liquid-cooled mold. The ceramic nozzle is mechanically clamped against the end of the mold, and is a tight fit; hence, there seemed to be little likelihood of air leaking through at this point. However, there is an extreme temperature differential between the nozzle, which is immersed at one end in a molten metal and has a constant stream of molten metal flowing through its center, and the liquid-cooled mold, which is less than 200° F. The temperature difference can thus range up to 3000° or more.

It was noted that the oxidation problem was more pronounced on very humid days, and it became evident that the problem was caused, at least in part, by moisture in the atmosphere. Whether the water vapor in the air was being dissociated by the extreme temperature differential at the interface, or served as a catalyst in the other chemical reactions that were taking place is a matter of speculation; the fact remains that a minute quantity of moist air was penetrating through the slightly porous ceramic nozzle and/or the interface, to produce oxidation of the cast metal, despite every effort to prevent it.

SUMMARY OF THE INVENTION

The primary object of the present invention is to provide a new and improved continuous casting machine of the class described wherein means is provided to positively preclude atmospheric gases from penetrating into the mold to produce oxidation of the cast metal product. This object is achieved by providing a shroud around the ceramic nozzle and the interface between the nozzle and the liquid-cooled mold, and injecting a dry, inert gas such as argon into the space enclosed by the shroud so that the nozzle and interface are blanketed with inert gas. At the same time, means is provided for surrounding the cast metal product with inert gas as it emerges from the mold and for a short distance beyond the mold while the metal cools by radiation.

The advantages of the invention are many; the useful life of the ceramic or refractory nozzle is greatly extended; breakage at the interface of the nozzle and liquid-cooled mold is eliminated because oxide by-products do not form; and the product being cast has a clean surface, and the casting marks do not have contaminates in them which are harmful to on-going metallurgical forming and treatments. Other important advantages are that the product has an improved composition because the nozzle does not oxidize; faster casting speeds and longer casting times are possible, resulting in improved productivity, and increased metal yield; and the useful life of the liquid-cooled mold is greatly extended by preventing oxidation of the cast metal product and the refractory nozzle. Still another advantage of the invention is that the improved horizontal casting process can be used successfully in regions of the world where high humidity is common to the atmosphere.

These and other objects and advantages of the invention will become apparent to those skilled in the art from the following detailed description of the preferred embodiment thereof, with reference to the accompanying drawings.

DESCRIPTION OF THE PREFERRED EMBODIMENT

Figure 1:
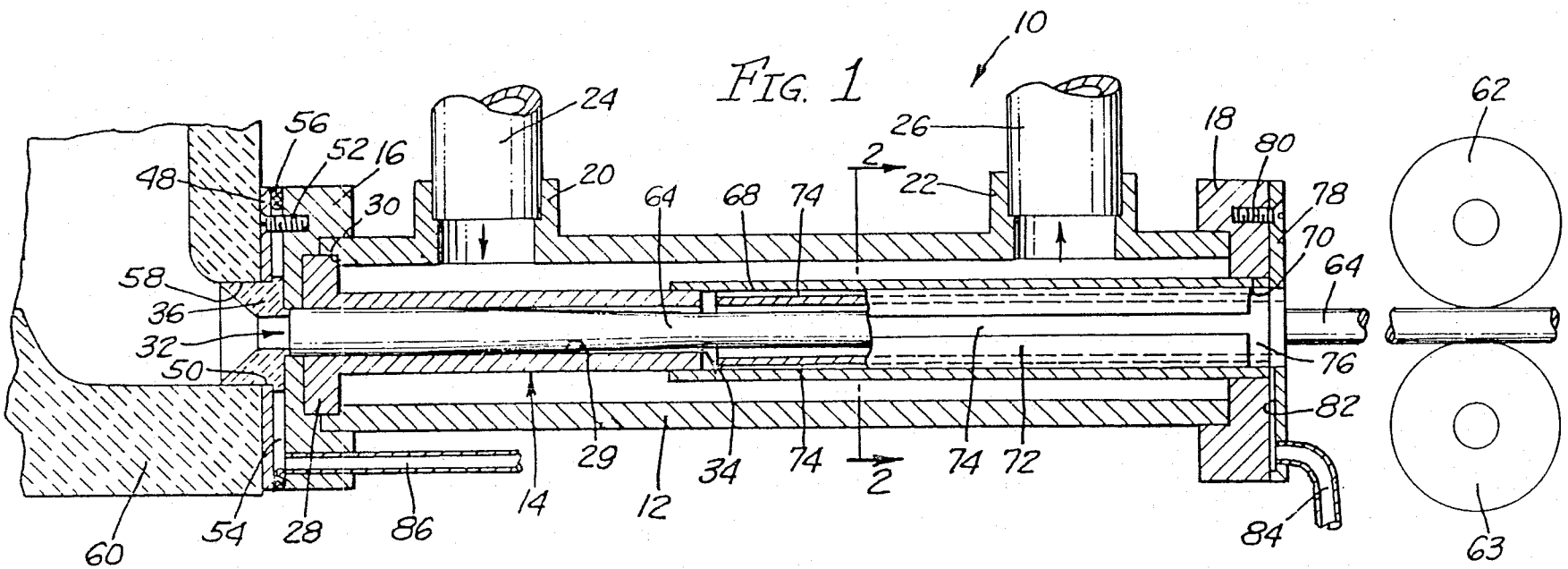
FIG. 1 is a longitudinal sectional view taken through a horizontal continuous caster embodying the invention.
Figure 2:
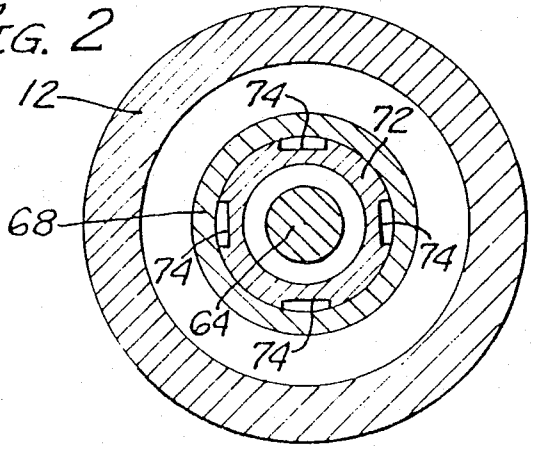
FIG. 2 is an enlarged cross-sectional view of the same, taken at 2—2 in FIG. 1.

In the drawings, the reference numeral 10 designates the horizontal continuous caster in its entirety. Caster 10 comprises a tubular housing 12, which contains a liquid-cooled mold 14. Housing 12 has end caps 16 and 18, which cooperate with the mold 14 and other internal elements to be described presently, to close the ends of the housing except for a central, longitudinally extending opening, within which the metal product is cast and travels lengthwise until it emerges from the exit end of the housing. Inlet and outlet bosses 20 and 22 are provided on the top surface of housing 12 near the ends thereof, and liquid coolant pipes 24 and 26 are connected to them.

The mold 14 is made of copper or other metal having high thermal conductivity, and is preferably in the form of a tube, with relatively thin walls and a radial mounting flange 28 at one end. The internal bore 29 of the tubular mold 14 is approximately the same size and cross-sectional configuration as the metal product to be cast, but is slightly larger than the finished product to allow for shrinkage.

Flange 28 is clamped tightly between end cap 16 and an annular shoulder 30 formed in the left-hand end of housing 12 as seen in FIG. 1, thereby centering the tubular portion of the mold within the housing, with an annular space between the outside of the mold 14 and the inner surface of the housing 12. Liquid coolant (usually water) is circulated through this annular space at high velocity, entering the housing through pipe 24 and exiting through pipe 26. Suitable means (not shown) produces turbulence in the water to increase the speed of heat transfer. One end 32 of the mold is its entrance end, and the other end 34 is its exit end.

Figure 3:
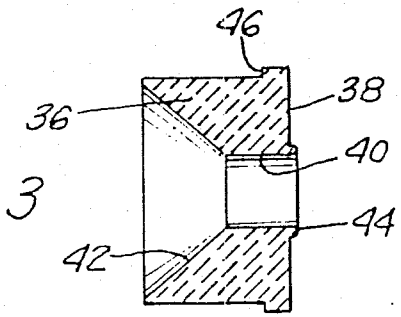
FIG. 3 is an enlarged sectional view through the nozzle.

Attached to the housing 12 at the entrance end of the mold is a nozzle 36 of zirconium oxide ceramic, which has an extremely high melting point and is totally non-reactive with any of the metals being cast. Zirconium oxide ceramic has microscopic pores and at temperatures above 1100° F. it has the property of transporting gas molecules through the material at an accelerated rate. As best shown in FIG. 3, the nozzle 36 is generally cylindrical in configuration, with a flat end surface 38, and a central bore 40 that is slightly smaller in diameter than the diameter of the bore 29 of the mold. Bore 40 extends for somewhat less than half the length of the nozzle, and then flares out into a wide, conical opening 42. A narrow lip 44 protrudes from the flat end surface 38 around the edge of the bore 40, and this lip projects into the bore 29 of the mold. The outer cylindrical surface of the nozzle is stepped near the right-hand end thereof, as seen in the drawings, forming a narrow annular shoulder 46, against which a pressure plate 48 bears to clamp the nozzle against the entrance of the mold 14. The contact area of the flat end surface 38 against the entrance end of the mold forms the interface between them.

Pressure plate 48 has a circular aperture 50 formed therein, through which the nozzle 36 passes. The diameter of the aperture 50 is such that the edges of the aperture bear against the annular shoulder 46. Pressure plate 48 is secured to the end cap 16 by screws 52, only one of which can be seen in FIG. 1, leaving a narrow gap 54 between the pressure plate and the end cap. A seal 56 of high-temperature-resistant fiber seals the outer edges of the gap 54.

When set up for casting, the projecting end of the nozzle 36 is inserted into a tap hole 58 in a furnace 60, or other reservoir of molten metal. Once casting is under way, the molten metal in the furnace 60 flows through the nozzle 36 into the water-cooled mold 14, where it freezes almost instantly and shrinks away from the mold. The shrinkage shown in FIG. 1 is greatly exaggerated for purposes of illustration, but the shrinkage is enough to free the metal casting from the mold so that the casting can be withdrawn therefrom.

The casting is withdrawn from the mold in an intermittent, step-by-step fashion, by means of a pair of pinch rolls 62, 63, at least one of which is driven by a motor (not shown). Basic production rates vary with different metals and alloys. However, present equipment is designed to produce wire or rod from 3 mm to 12 mm diameters at the rate of 5.5 to 7.3 meters per minute, while rod or wire from 75 mm to 200 mm diameter is produced at the rate of 1 to 6 meters per minute. In the smaller wire diameters, the cast metal product is withdrawn from the mold a distance of 18 to 30 mm with each advance, which is approximately one-fourth to one-third the length of the mold.

Upon leaving the exit end of the water-cooled mold 14, the cast wire 64 enters a tubular extension of the mold which constitutes a water-cooled heat sink. The heat sink may be longer than the mold 14, and its purpose is to rapidly absorb radiant heat from the hot metal emerging from th mold. Heat sink comprises a length of metal tubing 68, the inside diameter of which is approximately the same as the outside diameter of the mold at the exit end thereof, so that one end of the tubing can be telescoped over the exit end of the mold. The other end of the tubing 68 is seated within an aperture 70 in end cap 18.

Pressed into the tubing 68 in good heat-transfer contact therewith is a metal sleeve 72, the inner end of which is spaced a short distance from the exit end of the mold. Shallow, lengthwise-extending channels 74 are formed in the outer surface of the sleeve 72, and these channels cooperate with the inner surface of the tube 68 to form conduits, the purpose of which will become apparent presently. Near the right-hand end of the sleeve 72, the channels 74 open into a circumferential groove, or channel, 76. An end plate 78 has an aperture to receive the end of the sleeve 68, and the two are silver soldered together, so that the sleeve and end plate become a single unit. End plate 78 is secured to the outer end surface of cap 18 by screws 80, only one of which is visible in FIG. 1.

Formed in the inner surface of end plate 78 is a radially extending channel 82, the inner end of which opens into channel 76 on the tube 68, and the outer end of which terminates just short of the outer edge of the plate. Tubing 84 is connected to the end plate 78 and opens into the channel 82. Tubing 84 is connected to a source of dry, inert gas, such as argon or helium, under relatively low pressure, e.g., 4 psi. At the other end of the housing, a second tubing 86 is connected to end cap 16 and opens into the gap 54. Tubing 86 is also connected to the source of dry, inert gas under pressure.

When the caster is in operation, and molten metal is flowing into the mold, while cast wire is withdrawn from the mold by pinch rolls 62, 63, inert gas is injected into the gap 54 and surrounds and blankets the nozzle and interface. The inert gas diffuses through the porous zirconium oxide ceramic and displaces any oxygen in the surface pores of the nozzle bore 40 and conical opening 42, thereby forming a totally non-reactive shielding environment between the molten metal and the nozzle. Owing to the very low pressure of the inert gas in the gap 54 and the higher pressure of the molten metal against the inner surfaces of the nozzle, there is virtually no gas flow through the ceramic, other than that required to keep the surface pores filled with gas, and therefore virtually no gas enters the mold.

At the same time, dry, inert gas is discharged through tube 84 into the channel 82, where it flows into circumferential groove 76 and thence along longitudinal channels 74 to the end of the sleeve 72 adjacent the exit end of the mold. At this point, the gas flows inwardly around the end of the sleeve, and into the space between the cast wire 64 and the inner surface of the sleeve. The gas now flows outwardly with the cast wire and exhausts into the atmosphere, or it may be recovered and reused. While the hot cast wire is traveling through the sleeve 72, it radiates heat to the sleeve, which then transmits the heat conductively to the tubing 68, which is cooled by the water circulating in the housing 12. Thus, from the time the cast wire emerges from the exit end of the mold 14, until it exits from the end of housing 12, it is blanketed with dry inert gas, that excludes any atmospheric gas from the hot metal surface until the temperature has been substantially reduced. The resulting metal product has a clean, unblemished surface, and the surface life of both the nozzle 36 and liquid-cooled mold 14 is greatly extended.

While I have shown and described in considerable detail what I believe to be the preferred form of my invention, it will be understood by those skilled in the art that the invention is not limited to such details, but might take various forms within the scope of the claims.

What I claim is:

1. A horizontal continuous casting machine for producing metal product in the form of wire or rod, comprising:

a housing containing a liquid-cooled mold having an entrance end and an exit end;

an end cap overlying the entrance end of said mold and having a central aperture aligned with the bore of the mold;

a generally cylindrical nozzle of zirconium oxide ceramic disposed with one end thereof projecting into said aperture in said end cap, said nozzle having a central bore opening into said mold bore, and said nozzle also having a radial flange, one side of which bears against said end cap;

a pressure plate attached to said end cap and abutting against the other side of said radial flange;

an annular seal spaced radially outward from said nozzle flange and surrounding the nozzle, said seal enclosing the cavity between said end cap and said pressure plate; and means for supplying inert gas to said cavity at pressure above atmospheric but below the static pressure head of the molten metal within the nozzle, whereby the nozzle is surrounded and blanketed by inert gas, and the porous ceramic nozzle is permeated by the inert gas, thereby displacing oxygen from the surface pores when the molten metal passes through the nozzle.

2. A horizontal continuous casting machine as in claim 1, wherein said housing contains a liquid-cooled heat sink extending beyond the exit end of said mold, through which the cast metal product travels after it emerges from the exit end of the mold, said heat sink serving to quickly absorb radiant heat from the hot metal prior to its emergence from said housing;

said heat sink comprising a metal tube enclosed within said housing and having its outer surface exposed to liquid coolant circulating within the housing;

a sleeve inserted into the interior of said tube and in good heat-transfer contact therewith;

channel means formed in one of the contacting surfaces of said sleeve or said tube and extending from one end thereof to the other; and means for injecting inert gas into said channel means at the exit end of said housing, said inert gas flowing through said channel means to the exit end of said mold, where it enters the space between the inner surface of the sleeve and the cast metal product, the gas then surrounding the cast metal product and traveling in the same direction as the latter, until the product emerges from the exit end of the housing.

* * * * *